United States Patent [19]

Detemple et al.

[11] 4,284,321

[45] Aug. 18, 1981

[54] ELECTRODE HEAD

[75] Inventors: Manfred Detemple, Hofheim; Horst Huebner, Hochheim, both of Fed. Rep. of Germany

[73] Assignee: Schott-Geraete GmbH, Fed. Rep. of Germany

[21] Appl. No.: 45,618

[22] Filed: Jun. 5, 1979

[30] Foreign Application Priority Data

Jun. 28, 1978 [DE] Fed. Rep. of Germany ..... 2828248

[51] Int. Cl.[3] ..... G01N 27/36; H01R 17/18; H01R 4/22

[52] U.S. Cl. ..... 339/218 M; 204/195 G; 339/177 E

[58] Field of Search ..... 204/195 G, 271; 339/177 E, 177 R, 143 R, 218 R, 218 M, 278 D, DIG. 3

[56] References Cited

U.S. PATENT DOCUMENTS

| | | | |
|---|---|---|---|
| 3,258,735 | 6/1966 | Valle | 339/177 E |
| 3,476,672 | 11/1969 | Snyder et al. | 204/195 G |
| 3,643,208 | 2/1972 | Massa | 339/218 R X |
| 3,685,006 | 8/1972 | Jerrold-Jones | 339/218 R X |
| 3,806,440 | 4/1974 | Gray et al. | 204/195 G |
| 3,832,675 | 8/1974 | Detemple et al. | 339/143 R |

*Primary Examiner*—Eugene F. Desmond

*Attorney, Agent, or Firm*—Hill, Van Santen, Steadman, Chiara & Simpson

[57] ABSTRACT

A measurement electrode head system is disclosed for connection to electrodes for electrochemical potential measurement. The head includes an electrode cap for connection with glass and plastic electrode rods. A coaxial cable having an outer shielding conductor and an inner conductor connects to the cap. A plastic jacket is integrally molded onto one end of the coaxial cable. The jacket has a continuous electrically conductive shielding layer adjacent an inside surface thereof and the inner conductor of the cable connects with a connection element supported within and surrounded by the electrode cap and conductive shielding layer.

6 Claims, 2 Drawing Figures

ELECTRODE HEAD

BACKGROUND OF THE INVENTION

The invention relates to an electrode head, for instance for electrochemical potential measurement electrodes. The head comprises an electrode cap for connection with an electrode rod generally consisting of glass or plastics. Contacts are located in the electrode cap for connection with discharge connections from the electrode rod and a coaxial cable having an external conductor which serves, in general, as a screen and which is insulated from one or more internal conductors in the cable. The invention also relates to a process for the production of such an electrode head.

Measuring electrodes usually have a high internal resistance (~10 M Ohms). The connecting cable is consequently formed as a coaxial cable to ensure electrostatic screening. The core of the cable is connected with the actual measuring system. The electrostatic screening concentrically surrounding the cable core usually takes the form of a copper mesh and is connected either with the electrostatic screening or shielding within the electrode concentrically around the measuring system or, in the case of single rod measuring circuits, together with the reference system, simultaneously serving as a screen.

In electrode heads of such electrodes, the internal conductor of the potential transmitting element is generally connected to the electrode cable. The electrostatically screened potential is transmitted to the measuring instrument by means of the electrode cable. In the case of single rod measuring circuits, the reference electrode signal is also transmitted by way of the screening mesh.

A number of such electrode head designs is already known.

In one such design, an outer electrode head is in the form of a metal or plastics sleeve to which a cable grommet or a water-tight bush is fitted. Assemblies are also known in which the electrodes are fitted by screwing them into the head. Other designs favor a cylindrical rubber cap through which the cable is introduced from the top and which is secured to the glass electrode body. The cap in such designs is connected to the glass electrode body either by bonding with epoxy resin, silicone resin or other adhesive or cement or by simple press-fitting. The cable at such an electrode is connected with the internal conductor of the electrode within the so-called electrode head. This connection or link cable is connected with the internal conductor by soldering or welding, or by press contacts. In other designs the cable core extends further into the electrode and contact is effected with a plug contact or by means of metal wool within the electrode. The reference electrode connection is then connected by pressing or by soldering with the screening, transmitting the reference electrode signal to the measuring instrument.

All designs known hitherto have one or more of the following disadvantages:

The screening, i.e. in a single rod measuring circuit of the reference electrode connection, is in the form of an external jacket which is not insulated from the environment. In the event of moisture or manual contact with the head of the electrode, the reference system is short-circuited by way of the resultant shunt resistor or there is a double grounding;

The electrode head is secured mechanically by a screw arrangement, but with sufficient moisture-protection, so that the insulation resistance required for measurement purposes is not maintained in the long term between the cable core and the screening of the coaxial cable;

The electrode head has no shielding protection at all in the case where a metal sleeve is used as the electrode head, and the metal sleeve is not connected to the screen system. Such electrode designs are hand-sensitive as a result of electrostatic discharges;

The cable core and screening are connected in each case by soldering to the internal contacts. The soldering is subject to the hazard of cold joints and is also highly costly.

SUMMARY OF THE INVENTION

An object of the invention is consequently to provide an electrode head of the aforegoing type, which obviates the above disadvantages and more particularly, enables a full insulation of the reference signal and screening with respect to the outside, an uninterrupted screening continuity, solder-free connections between the discharge connections from the electrode rod and the contacts in the electrode head allowing a hermetically sealed connection with the electrode rod, a short assembly time, and chemical resistance against all chemicals likely to be encountered in service. This object is fulfilled by an electrode head of the aforegoing type according to the invention wherein the electrode cap consists of a plastics jacket integrally moulded securely onto one end of the connection cable. The plastics jacket has, on its inside, an essentially electrically-conductive layer directly linked with the discharge cable outer conductor which is generally in the form of a wire mesh. The inner conductor or conductors of the discharge cable is insulated as it passes or they pass through the electrically-conducting layer and is or are provided with a or a respective connecting component on the inside of the electrode cap. A further connecting component for the outer conductor of the discharge cable is connected on the front of the electrode cap with the electrically conductive layer.

In a manufacturing process according to the invention, the metal component forming the metal conductive layer is connected with the outer conductor of the connecting cable at one end thereof. The (or each) inner conductor is connected with the respective connection components, and the assembly thus obtained is placed in a mould and is then overmoulded with a plastic jacket.

In the case where the electrically-conductive layer within the plastics cap consists of an applied layer, the placing of a metal component forming the electrically-conductive layer in the mould can be dispensed with and the layer can be applied after moulding. It may also be desirable to fit an insulating component into the mould to serve as a guide for the inner conductor(s) through the electrically-conductive layer.

The arrangement and process for the electrode caps according to the invention offers a number of decisive advantages. As a result of the electrode cap being injected directly onto the cable, a fully hermetically sealed and moisture-impervious connection is achieved between both components. The electrically-conductive layer inside the electrode caps, preferably in the form of a metal sleeve, ensures the continuous shielding of the electrode head. This injection technique allows the inner metal sleeve to connect the electrode cap in the shortest path with the outer conductor of the cable in the form of a wire mesh. The central inner conductor of the cable, ending in the center of the assembly, can be easily connected with a socket. A further plug or socket is fitted to the sleeve in a suitable position, so that the reference electrode signal and/or the sleeve may also be easily connected to the inside of the electrode rod. The creation of the electrical connection between the inner contact of the electrode rod and the connections of the electrode head coming from the cable is easily achieved by a simple manual operation, by the insertion of a metal wire of the required thickness into the relevant contact sockets. This simple plug-in technique allows a considerable reduction of the time required for connecting the electrodes with the cables. It is important to note that assembly errors are also greatly reduced.

As a result of the fact that the cable is solidly moulded in with the remainder of the assembly, the otherwise essential, expensive and time-consuming vulcanization or other fitting of operationally reliable and, more particularly, moisture-resistant cable grommets or sleeves to the electrode head is dispensed with. The requirement to draw the cable through the sleeve is also eliminated. During assembly of the electrode head and the electrode rod, no uninsulated discharge cable is exposed, so that any fouling is excluded.

The glass body of the electrode rod is easily connected by casting or bonding with an adhesive onto the new electrode head, thus hermetically sealing it against pollution of any nature such as moisture.

Trouble-free electrostatic screening of the electrode is ensured by using the electrode head of the invention. In the lower glass jacketed part of the electrode, shielding is ensured according to the present state of the art concerning single rod measuring circuits by means of an electrolyte solution, e.g. a KCl solution. Immediately at the point where the electrolyte screen reaches its upper boundary, the screening or shielding provided by the metal-conductive layer in the electrode head commences. This metallic conductive layer covered externally with plastic, also surrounds the upper part of the electrode rod filled with connecting casting resin or cement. Immediately adjacent to the electrode cap, the screening by the outer conductor of the coaxial cable takes over up to the measuring instrument.

Electrical insulation from external influences for the screening and the reference potential, for instance double grounding, is also ensured. The moulded plastics jacketed part of the electrode head according to the invention is directly joined to the glass outer jacket of the electrode rod. The plastic is hermetically sealed against the cable and also surrounds part of the cable outer jacket, so that a fully moisture-proof seal and consequently a higher insulating resistance to the outside is achieved.

The electrode head according to the invention is similarly applicable to reference electrodes or identically designed measuring systems, such as conductivity measuring cells, double platinum measuring electrodes for polarization current or polarization voltage titrations, oxygen electrodes or equal temperature probes using, for instance, resistance thermometers type PT 100 in various designs. As an example, a glass electrode design may be used in conjunction with wire plug-pins instead of the above-mentioned plug sockets, with the wire plug pins being easily inserted into sockets on the electrode rod. The number of contacts can vary. The end of the cable can be fitted as desired with a plug-in contact or with clamp terminals.

DESCRIPTION OF THE PREFERRED EMBODIMENTS

Figure 1:
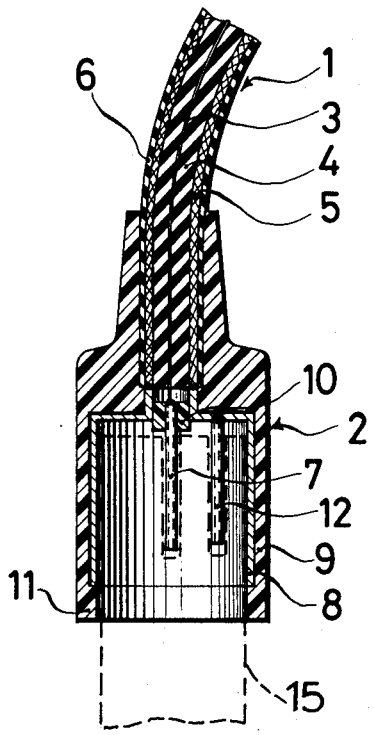
FIG. 1 is a cross-sectional view taken through an electrode head with an internal conductor and a plug socket located within the electrode cap.
Figure 2:
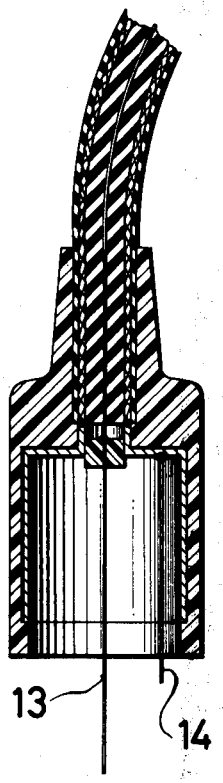
FIG. 2 is an electrode head corresponding to FIG. 1 but fitted with plug pins inside the electrode cap.

The electrode head represented in FIG. 1 consists of a coaxial cable 1 and an electrode cap assembly 2. The cable 1 is made up of an inner conductor 3, an inner insulation (dielectric) 4, a screening braiding 5, and an outer insulation 6. The electrode cap 2 is injection moulded and comprises a plastic-jacket 9 surrounding an end portion of the cable 1, a cylindrical screening sleeve 8 and an extremely high resistance plastics adjustment or spacing piece 10 mounted within a smaller diameter cylindrical section of the screening sleeve 8 ensuring that the inner conductor 3 and sleeve 8 do not touch during the production process. The lower part 11 of the plastics jacket 9 projects slightly further than the sleeve 8 so as to ensure that the latter is completely insulated externally. The jacket 9 is injection-moulded around the sleeve 8. The inner conductor 3 terminates inside the electrode head in a contact bush 7 or socket contact. Another contact bush 12 or socket contact has screening or shielding which is electrically connected with the screening or shielding sleeve 8 and consequently with the shielding braiding 5 of the cable 1. The contact bushes 7 and 12 may alternatively take the form of plug pins 13 and 14 as shown in FIG. 2. The electrode head fits over the end of a glass or plastic electrochemical measurement rod 15 as shown in FIG. 1.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A measurement electrode head system, comprising: an electrochemical potential measurement glass or plastic electrode rod; a one piece electrode cap means in direct connection with the electrode rod; at least one contact in said cap means in connection with an output connection wire or pin from the electrode rod; a coaxial cable having an insulated outer shielding conductor surrounding at least one insulated inner conductor; said electrode cap means including a plastic jacket integrally moulded onto one end of the coaxial cable, said jacket and a continuous electrically conductive shielding layer adjacent an inside surface thereof dimensioned to tightly surround and in direct contact with a peripheral wall of the glass or plastic rod at an end thereof, said layer being connected directly to the outer conductor of the cable; at least one inner conductor of the coaxial cable directly connecting to a connection socket supported within and surrounded by the electrode cap means and conductive shielding layer; and the connection socket being dimensioned to receive the electrode rod connection wire or pin in solderless contact therewith.

2. A measurement electrode head system according to claim 1 wherein the conductive shielding layer within the electrode cap means has a large diameter cylindrical section and a smaller diameter cylindrical section, and wherein an insulating spacing element is mounted in the smaller diameter cylindrical section with the connection socket supported by the spacing element and the coaxial cable inner conductor connecting to the connection socket adjacent an end of the spacing element.

3. A measurement electrode head system for connection to electrochemical potential measurement glass and plastic electrode rods, comprising: one piece electrode cap means for connection with the electrode rods; at least one contact in said cap means for connection with an output connection socket from the electrode rod; a coaxial cable having an insulated outer shielding conductor surrounding at least one insulated inner conductor; said electrode cap means including a plastic jacket integrally moulded onto one end of the coaxial cable, said jacket and a continuous electrically conductive shielding layer adjacent an inside surface thereof dimensioned to tightly surround and contact a periphery of the glass or plastic end of the electrode rod, said layer being connected directly to the outer conductor of the cable; at least one inner conductor of the coaxial cable directly connecting to a connection pin supported within and surrounded by the electrode cap means and conductive shielding layer; and the connection pin being dimensioned for insertion into the electrode rod output connection socket for solderless contact therewith.

4. A measurement electrode head system according to claim 3 wherein the conductive shielding layer within the electrode cap means has a large diameter cylindrical section and a smaller diameter cylindrical section, and wherein an insulating spacing element is mounted in the smaller diameter cylindrical section with the connection pin supported by the spacing element and the coaxial cable inner conductor connecting to the connection pin adjacent an end of the spacing element.

5. A method for producing a measurement electrode head system for connection to an electrochemical potential measurement glass or plastic electrode rod, said electrode head including a one-piece electrode cap receivable directly on one end of the electrode rod, said cap also connecting to a coaxial cable having an outer shielding conductor and an inner conductor, comprising the steps of: providing a continuous cylindrical metal conductive layer having dimensions adapted to permit a tight fit over the glass or plastic end of the electrode rod; connecting the metal conductive layer at an end of the cable directly to the outer conductor of the cable; connecting the inner conductor of the cable to a connection socket adapted for solderless contact of a pin or wire of the electrode rod to be inserted therein; supporting the connection socket within the cylindrical metal conductive layer by a spacer element received in a smaller diameter cylindrical portion of the layer; placing the resulting assembly in a mould and overmoulding the assembly with a plastic jacket which extends over a portion of an end of the cable and over a substantial portion of the outer shielding conductor so as to hermetically seal the electrode head; and placing the completed one-piece cap over the end of the rod such that the cylindrical metal conductive layer is in a direct hermetic contact with a peripheral wall of the rod.

6. A method for producing a measurement electrode head system for connection to an electrochemical potential measurement glass or plastic electrode rod, said electrode head including a one-piece electrode cap receivable directly on one end of the electrode rod, said cap also connecting to a coaxial cable having an outer shielding conductor and an inner conductor, comprising the steps of: providing a continuous cylindrical metal conductive layer having dimensions adapted to permit a tight fit over the glass or plastic end of the electrode rod; connecting the metal conductive layer at an end of the cable directly to the outer conductor of the cable; connecting the inner conductor of the cable to a connection pin adapted for solderless contact of a socket of the electrode rod which receives the pin; supporting the connection pin within the cylindrical metal conductive layer by a spacer element received in a smaller diameter cylindrical portion of the layer; placing the resulting assembly in a mould and overmoulding the assembly with a plastic jacket which extends over a portion of an end of the cable and over a substantial portion of the outer shielding conductor so as to hermetically seal the electrode head; and placing the completed one-piece cap over the end of the rod such that the cylindrical metal conductive layer is in a direct hermetic contact with a peripheral wall of the rod.

* * * * *